US010135170B2

(12) United States Patent
Mundt et al.

(10) Patent No.: US 10,135,170 B2
(45) Date of Patent: Nov. 20, 2018

(54) CONTACT GEOMETRY FOR CONTACTS IN HIGH SPEED DATA CONNECTORS

(71) Applicant: DELL PRODUCTS, LP, Round Rock, TX (US)

(72) Inventors: Kevin W. Mundt, Austin, TX (US); Bhavesh Patel, Austin, TX (US); Bhyrav M. Mutnury, Round Rock, TX (US)

(73) Assignee: DELL PRODUCTS, LP, Round Rock, TX (US)

( * ) Notice: Subject to any disclaimer, the term of this patent is extended or adjusted under 35 U.S.C. 154(b) by 0 days.

(21) Appl. No.: 15/403,688

(22) Filed: Jan. 11, 2017

(65) Prior Publication Data

US 2018/0198227 A1 Jul. 12, 2018

(51) Int. Cl.

| | |
|---|---|
| ***H01R 13/28*** | (2006.01) |
| ***H01R 25/00*** | (2006.01) |
| ***H01R 13/26*** | (2006.01) |
| ***H01R 24/84*** | (2011.01) |

(52) U.S. Cl.
CPC ..... *H01R 13/26* (2013.01); *H01R 24/84* (2013.01)

(58) Field of Classification Search
CPC ..... H01R 23/27; H01R 24/84
USPC ..... 439/284, 287, 293, 294
See application file for complete search history.

(56) References Cited

U.S. PATENT DOCUMENTS

| | | | | |
|---|---|---|---|---|
| 5,334,962 | A | 8/1994 | Higgins et al. | |
| 5,940,562 | A | 8/1999 | Henson et al. | |
| 6,540,529 | B1 * | 4/2003 | Yu | H01R 24/84 439/74 |
| 6,702,590 | B2 * | 3/2004 | Zaderej | H01R 12/7082 439/74 |
| 7,649,745 | B2 | 1/2010 | Meier et al. | |
| 8,277,241 | B2 * | 10/2012 | Horchler | H01R 24/84 439/295 |
| 2010/0167569 | A1 * | 7/2010 | Stoner | H01R 13/193 439/284 |
| 2013/0102177 | A1 * | 4/2013 | Venaleck | H01R 13/28 439/295 |
| 2013/0102199 | A1 * | 4/2013 | Venaleck | H01R 24/84 439/626 |
| 2014/0295681 | A1 * | 10/2014 | Miyaki | H01R 24/84 439/65 |

* cited by examiner

*Primary Examiner* — Abdullah Riyami
*Assistant Examiner* — Thang Nguyen
(74) *Attorney, Agent, or Firm* — Larson Newman, LLP

(57) ABSTRACT

A connector system includes a first connector element and a second connector element. The first connector element includes a first contact that has a first contact region and a first wipe region. The second connector element includes a second contact that has a second contact region and a second wipe region. When the first connector element is mated with the second connector element, the first contact region makes a first point electrical contact with the second wipe region such that the first contact does not form a first tuned electrical stub.

15 Claims, 7 Drawing Sheets

700

CONTACT GEOMETRY FOR CONTACTS IN HIGH SPEED DATA CONNECTORS

FIELD OF THE DISCLOSURE

This disclosure generally relates to information handling systems, and more particularly relates to a contact geometry for contacts in high speed data connectors.

BACKGROUND

As the value and use of information continues to increase, individuals and businesses seek additional ways to process and store information. One option is an information handling system. An information handling system generally processes, compiles, stores, and/or communicates information or data for business, personal, or other purposes. Because technology and information handling needs and requirements may vary between different applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, reservations, enterprise data storage, or global communications. In addition, information handling systems may include a variety of hardware and software resources that may be configured to process, store, and communicate information and may include one or more computer systems, data storage systems, and networking systems.

Various components in an information handling system may be connected together via connectors that carry high speed data signals between the components. As data speeds increase, signal performance may be degraded due to unwanted parasitic effects in the connectors. FIG. 1 illustrates a connector system including a connector element 100 and a mating connector element 110. Connector element 100 includes a connector element housing 102 and a contact 104, and mating connector element 110 includes a connector element housing 112 and a contact 114. Contact 104 is connected to a node (not illustrated) of an information handling system that is associated with an electrical signal at a first component of the information handling system, and contact 114 is connected to another node (not illustrated) of the information handling system that is associated with the electrical signal at a second component of the information handling system. When mating connector element 110 is fully inserted in to connector element 100, contact 104 makes a point contact 106 with contact 114, and contact 114 makes a point contact 116 with contact 104, thereby connecting the electrical signal at the first component to the electrical signal at the second component. However, when mating connector element 110 is fully inserted in to connector element 100, a portion of contact 104 that is beyond contact point 106 forms a tuned stub 108, and a portion of contact 114 that is beyond contact point 116 forms a tuned stub 118. Tuned stubs 108 and 118 can induce a frequency dependent resonance into the electrical signal that leads to unwanted signal degradation. Tuned stubs 108 and 118 can be from 200 to 500 millimeters (mm) long.

BRIEF DESCRIPTION OF THE DRAWINGS

It will be appreciated that for simplicity and clarity of illustration, elements illustrated in the Figures have not necessarily been drawn to scale. For example, the dimensions of some of the elements are exaggerated relative to other elements. Embodiments incorporating teachings of the present disclosure are shown and described with respect to the drawings presented herein, in which.

The use of the same reference symbols in different drawings indicates similar or identical items.

SUMMARY

A connector system may include a first connector element and a second connector element. The first connector element may include a first contact that has a first contact region and a first wipe region. The second connector element may include a second contact that has a second contact region and a second wipe region. When the first connector element is mated with the second connector element, the first contact region may make a first point electrical contact with the second wipe region such that the first contact does not form a first tuned electrical stub.

DETAILED DESCRIPTION OF DRAWINGS

The following description in combination with the Figures is provided to assist in understanding the teachings disclosed herein. The following discussion will focus on specific implementations and embodiments of the teachings. This focus is provided to assist in describing the teachings, and should not be interpreted as a limitation on the scope or applicability of the teachings. However, other teachings can certainly be used in this application. The teachings can also be used in other applications, and with several different types of architectures, such as distributed computing architectures, client/server architectures, or middleware server architectures and associated resources.

Figure 2:
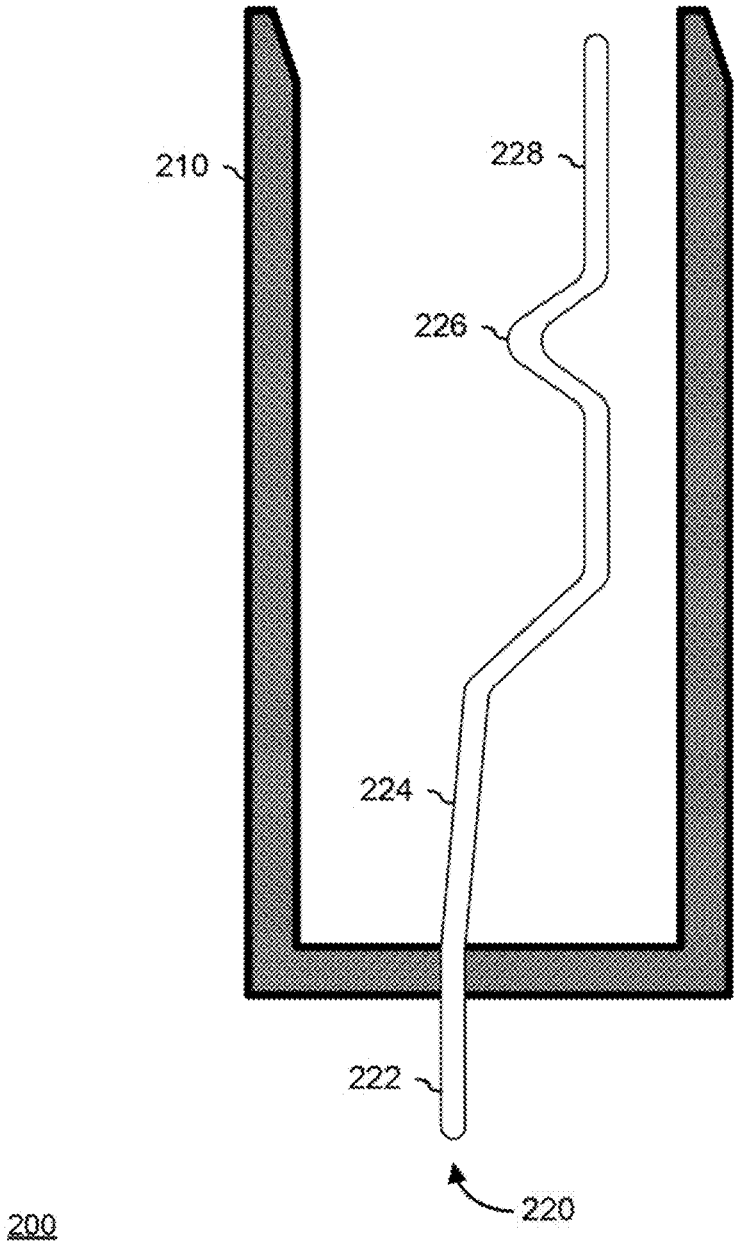
FIG. 2 is a cross-sectional view of a connector element of a connector system according to an embodiment of the present disclosure.

FIG. 2 illustrates a cut-away view of a connector element 200 including a connector element housing 210 and a contact 220. Connector element 200 represents one side of a connector system that provides electrical connections between, for example, components of an information handling system. As such, connector element 200 is associated with a single electrical signal between the components. Contact 220 is electrically connected to a node of the first component that is associated with the electrical signal, and a mated connector element of the connector system (not shown) is connected to a node of the second component that is also associated with the electrical signal. When connector element 200 is mated to the mated connector element, contact 220 makes an electrical contact with a contact pin of the mated connector element, thereby connecting the first node to the second node.

Connector element housing 210 represents a rigid, non-conductive mechanical structure that retains contact 220, and, as illustrated further below, that guides the contact pin into a position to make an electrical connection with a contact pin of a mated connector element. Connector element housing 210 also operates to firmly hold to the mated connector element, such that the sides of the connector system do not easily become disconnected. In a particular embodiment, connector element 210 and the mated connector element form a male-female pair, such that one connector element is inserted into the other connector element. In another embodiment, connector element 200 and the mated connector element form a hermaphroditic pair, such that mating surfaces of the connector elements have complementary paired identical parts each, such as matching protrusions and indentations. In other embodiments, connector element 200 and the mated connector element form a different mechanical coupling arrangement. The specifics of the mechanical coupling arrangement described herein, and of mechanical coupling arrangements in general, are known in the art, and will not be discussed further herein, except as needed to elaborate on the features of connector element 200 of the connector system.

Contact 220 represents a conductive electrical structure that is connected to a node, such as a particular electrical signal node associated with a first component of an information handling system, and, as illustrated further below, that makes an electrical connection with a contact pin of a mated connector element, that is, itself connected to the particular electrical signal node associated with a second component of the information handling system. In a particular embodiment, contact 220 is formed from plated spring steel. For example, contact 220 may be lead-tin (solder) plated, silver plated, gold plated, or may be plated with another conductive material, as needed or desired. Contact 220 may have an overall length that is defined by a geometry of the connector system, but that can typically be in the range of 2-6 millimeters (mm). Particular embodiments may be shorter or longer, as needed or desired. In a particular embodiment, contact 220 is formed using a square stock that is bent to the desired shape. Here, contact 220 may represent a pin arrangement that is 0.75-1.25 mm wide and 0.75-1.25 mm deep. In another embodiment, contact 220 is formed using a flat stock that is bent to the desired shape. Here, contact 220 may represent a wiper arrangement that is 0.75-1.25 mm wide, and 1-5 mm deep.

Contact 220 includes a tail region 222, a wipe region 224, a ramp region 226, and a contact region 228. Tail region 222 provides a connection area for connecting contact 220 to the particular node. In a particular embodiment, in connecting tail region 222 to the node, the tail region is connected to a wire, such as where the first side of the connector system is affixed to a cable or harness. In another embodiment, tail region 222 is affixed to a conductor of a printed circuit board (PCB). In a first configuration, tail region 222 can be soldered into the PCB such that connector element 200 is situated orthogonally to the PCB. In another configuration, tail region 222 can include a bend, such as a 90 degree bend, so that the tail region can be soldered into the PCB such that connector element 200 is situated in parallel with a surface of the PCB. The skilled artisan will understand that tail region 222 is therefore representative of a wide variety of configurations for tail regions in various connectors, as are known in the art.

Wipe region 224 provides a landing spot for making electrical contact with a contact region of a contact of a mated contact element, as described further below. Ramp region 226 provides a sliding contact between contact 220 and the contact of the mated contact element, such that the contacts displace each other to prevent the contact region of one contact from interfering with the wipe region of the other contact, as described further below. Contact region 228 makes an electrical contact with the wipe region of the contact of the mated contact element, as described further below.

It will be understood that the first side of the connector system may include multiple connector elements similar to connector element 200, each associated with a single electrical signal between components of the information handling system, and that a mating side of the connector system will include an equivalent number of connector elements, each associated with the respective electrical signal. The connector elements can be arranged in rows, in stacks of rows, in concentric circles of connector elements, or in another arrangement, as needed or desired. Note that more than one connector element of the first side of the connector system may be associated with the same electrical signal, as needed or desired to provide improved electrical performance of the signals between the components.

FIGS. 3-6 illustrate a connector system, including connector element 200 and a mating connector element 300, in various stages of being inserted together. Mating connector element 300 is similar to connector element 200, and includes a connector element housing 310 similar to connector element housing 210, and a contact 320 similar to contact 220. As such, contact 320 includes a tail region 322 similar to tail region 222, a wipe region 324 similar to wipe region 224, a ramp region 326 similar to a ramp region 226, and a contact region 328 similar to contact region 228. Note that, as illustrated, connector element 200 and mating connector element 300 are symmetrical. Here, it will be understood that one or more of connector element housings 210 and 310 may include additional structures (not illustrated) that firmly hold the sides of the connector system together, such that the sides of the connector system do not easily become disconnected. Such structures are known in the art and will not be further discussed herein.

Figure 3:
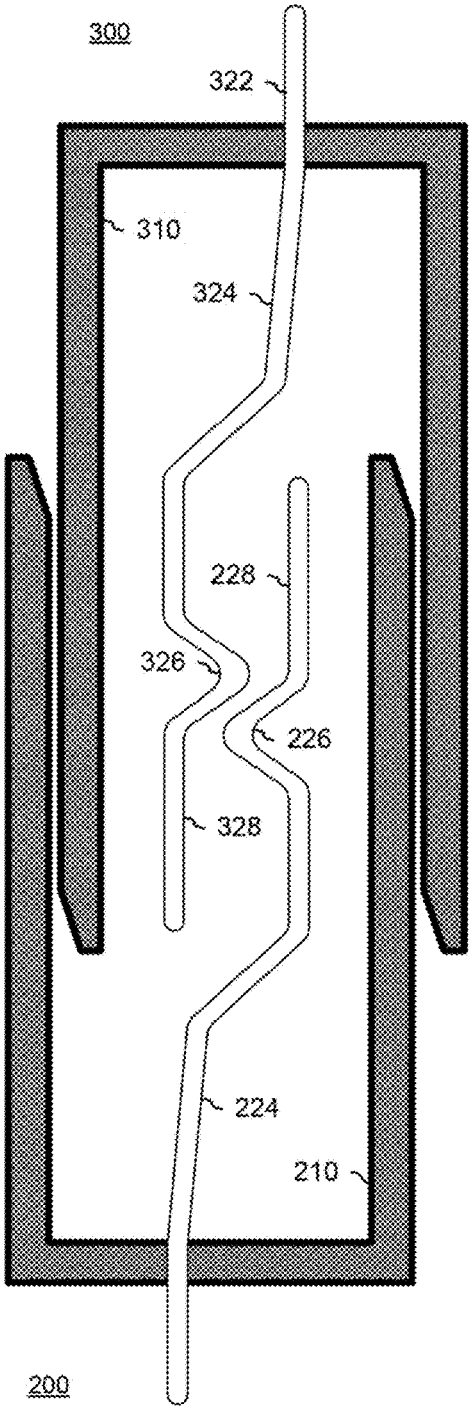
FIGS. 3-6 are cross-sectional views of a connector system including the connector element of FIG. 1.

FIG. 3 illustrates a first insertion stage where mating connector element 300 is partially inserted into connector 200. Note that here contact region 228 has been inserted past ramp region 326 and that likewise contact region 328 has been inserted passed ramp region 226, but that the ramp regions have not yet made physical contact. As such no mechanical or electrical contact has been made between contact 220 and contact 320. As such, at this point, the node that is connected to contact 220 is not yet connected to the node connected to contact 320.

Figure 4:
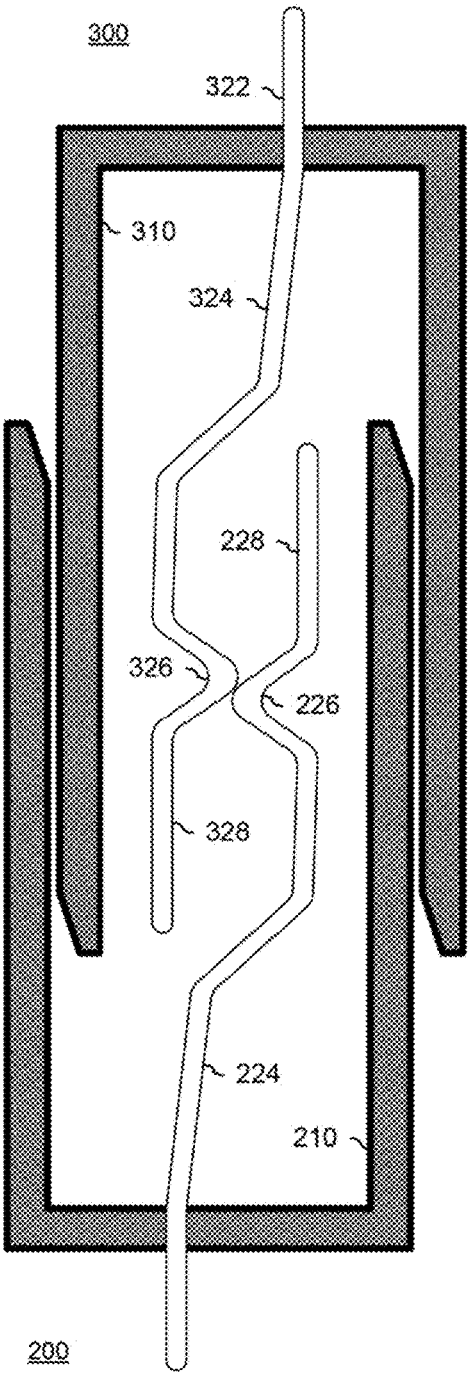

FIG. 4 illustrates a second insertion stage where mating connector element 300 is inserted more fully into connector 200. Note that here, ramp region 226 and ramp region 326 have begun to interface with each other, such that the ramp regions are sliding against each other to deflect contact region 228 away from contact region 324, and to deflect contact region 328 away from contact region 224. Note that while ramp region 226 is sliding against ramp region 326, the node that is connected to connector 220 is electrically connected to the node that is connected to connector 320. However, the connection formed while ramp region 226 is sliding against ramp region 326 is a spurious connection that, as described further below, will lead to degraded signal performance at certain signal speeds. This degradation in signal performance occurs because the length of contacts 220 and 320 that are passed the point of electrical connection, including a portion of ramp region 226 and all of contact region 228 on contact 220 and a portion of ramp region 326 and all of contact region 328 on contact 320, each form a tuned stub that will introduce unwanted resonance at certain frequencies.

Note that, at the insertion depths where ramp region 226 is interfacing with ramp region 228, such resonance effects are unpredictable, because a small difference in the insertion depth will lead to a different resonance frequency of the tuned stubs formed. Moreover, slight variations in the profiles of ramp regions 226 and 326 may mean that the tuned stub formed by the portion of ramp region 226 and contact region 228 on contact 220 may have different resonance characteristics than the tuned stub formed by the portion of ramp region 326 and contact region 328 on contact 320. As such, in a particular embodiment, the connector system is configured to ensure that the formation of the tuned stubs on contacts 220 and 320 are not formed. In a first configuration, one or more of connector element housings 210 and 310 are formed to ensure that connector elements 200 and 300 do not remain in a partially inserted stage. For example, the connector system can include a clasp mechanism that is unable to be clasped when connector elements 200 and 300 are partially inserted. In another configuration, the contacting surfaces of ramp regions 226 and 326 can be covered with a non-conductive substance, such that when ramp region 226 is interfacing with ramp region 326, no electrical connection is formed between the node connected to contact 220 and the node connected to contact 320. For example, ramp regions 226 and 326 can be covered with an adhesive Teflon layer, or another non-conductive substance, as needed or desired.

Figure 5:
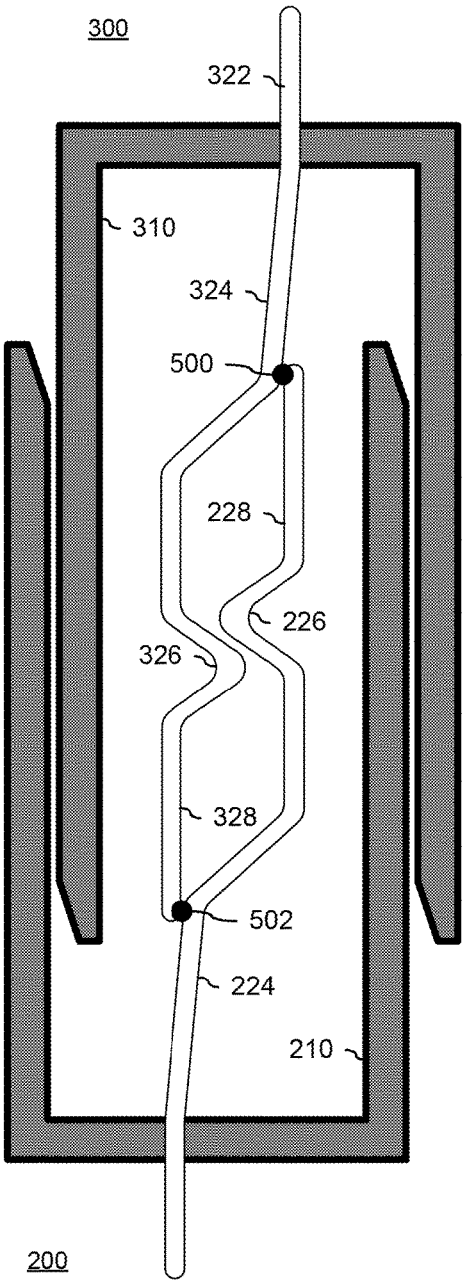

FIG. 5 illustrates a third insertion stage where mating connector element 300 is still more fully inserted into connector 200. Note that here ramp region 226 has been inserted past ramp region 326. At this insertion depth, contact region 228 makes a point contact 500 with wipe region 324 and contact region 328 makes a point contact 502 with wipe region 224, such that the node that is connected to connector 220 is electrically connected to the node that is connected to connector 320. However, as opposed to the insertion depth shown in FIG. 4, the connection formed when contact region 228 makes point contact 500 with wipe region 324 and contact region 328 makes point contact 502 with wipe region 224 is not a spurious connection because little or no tuned stub is formed beyond point contacts 500 and 502.

More particularly, it may be possible that the tip of one or more of contacts 220 and 320 slightly protrudes beyond point contacts 500 and 502, thereby forming a short tuned stub. For example, one or the other of contact regions 228 and 328 may have a slight upward bend, due, for example, to a designed profile of contacts 220 and 320, or to unintended bending of the contacts resulting from prior insertions of mating connector element 300 into connector element 200. Here, a short tuned stub may be formed beyond one or more of point contacts 500 and 502. However, due to the short length of such a tuned stub, any resonance frequency associated with the tuned stub would likely be much higher than the typical data bandwidth frequency of the electrical signal carried on connectors 220 and 320. For example, given present data bandwidths in the 10-15 gigabits per second (gbps) range, and near future bandwidths in the 15-30 gbps range, a tuned stub length that has a resonance frequency above 30 gbps will provide for undegraded electrical performance due to the presence of such a tuned stub. For the purposes of the present disclosure, any tuned stub formed by connectors 220 or 320 can be assumed to be shorter than the width of the connector. As such, the geometry of connectors 220 and 320 can be less than 0.75 mm.

Figure 6:
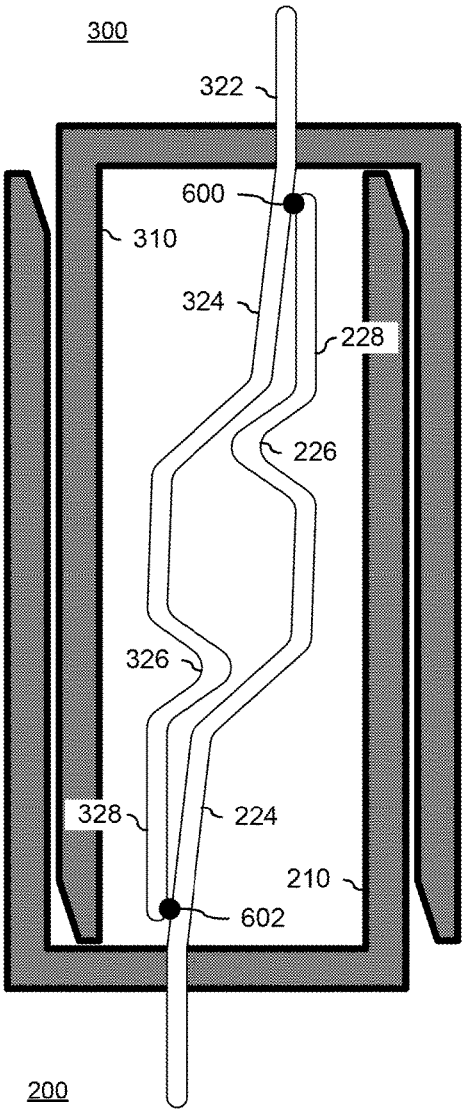

FIG. 6 illustrates a final insertion stage where mating connector element 300 is fully inserted into connector 200. Note that here connector region 228 has been inserted to the end of wipe region 324 and connector region 328 has been inserted to the end of wipe region 224. At this insertion depth, contact region 228 makes a point contact 600 with wipe region 324 and contact region 328 makes a point contact 602 with wipe region 224, such that the node that is connected to connector 220 remains electrically connected to the node that is connected to connector 320, and little or no tuned stub is formed beyond point contacts 600 and 602.

Figure 1:
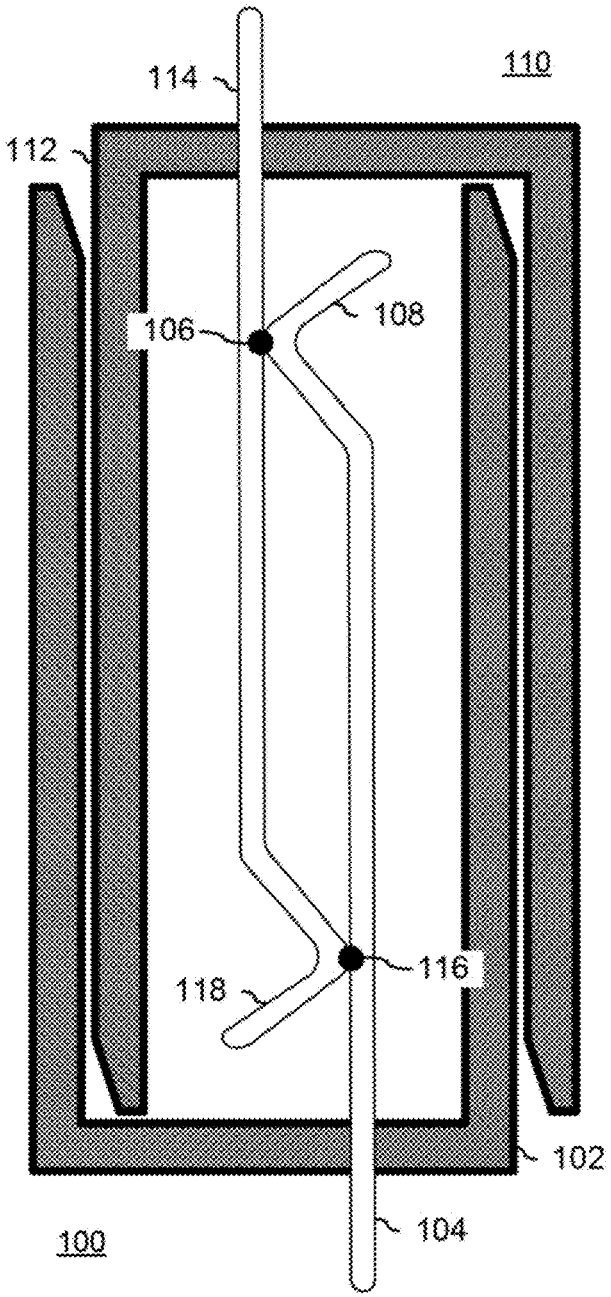
FIG. 1 (Prior Art)
FIG. 1 is a cross-sectional view of a connector system according to the prior art.
Figure 7:
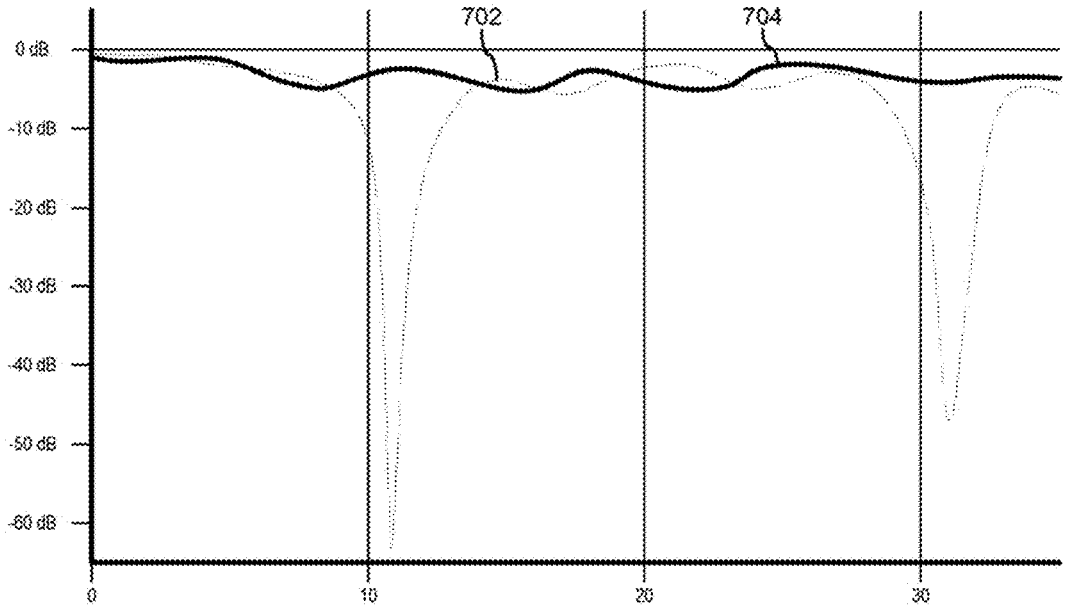
FIG. 7 is a graph of an insertion loss response of a connector system according to an embodiment of the present disclosure.

FIG. 7 is a graph 700 of the insertion loss for connector systems as a function of the operating frequency. The insertion loss 702 for a typical connector system, such as the connector system of FIG. 1 is shown as a dotted line. Note that insertion loss 702 is greater than 60 dB at about 11 gbps data rate, and is greater than 45 dB at about 31 gbps data rate. The insertion loss 704 for a connector system of the present disclosure, such as the connector system of FIG. 3 is shown as a solid line. Note that at no point is the insertion loss greater than 10 dB due to the reduced length of the tuned stub formed by the tip of the exemplary contact region. As such, the contact profile of the present disclosure provides for a flatter insertion loss response across a wide range of frequencies, and thus the contact profile of the present disclosure provides for an improved connection mechanism between nodes because there are not operating frequencies that must be avoided to avoid performance degradations.

Figure 8:
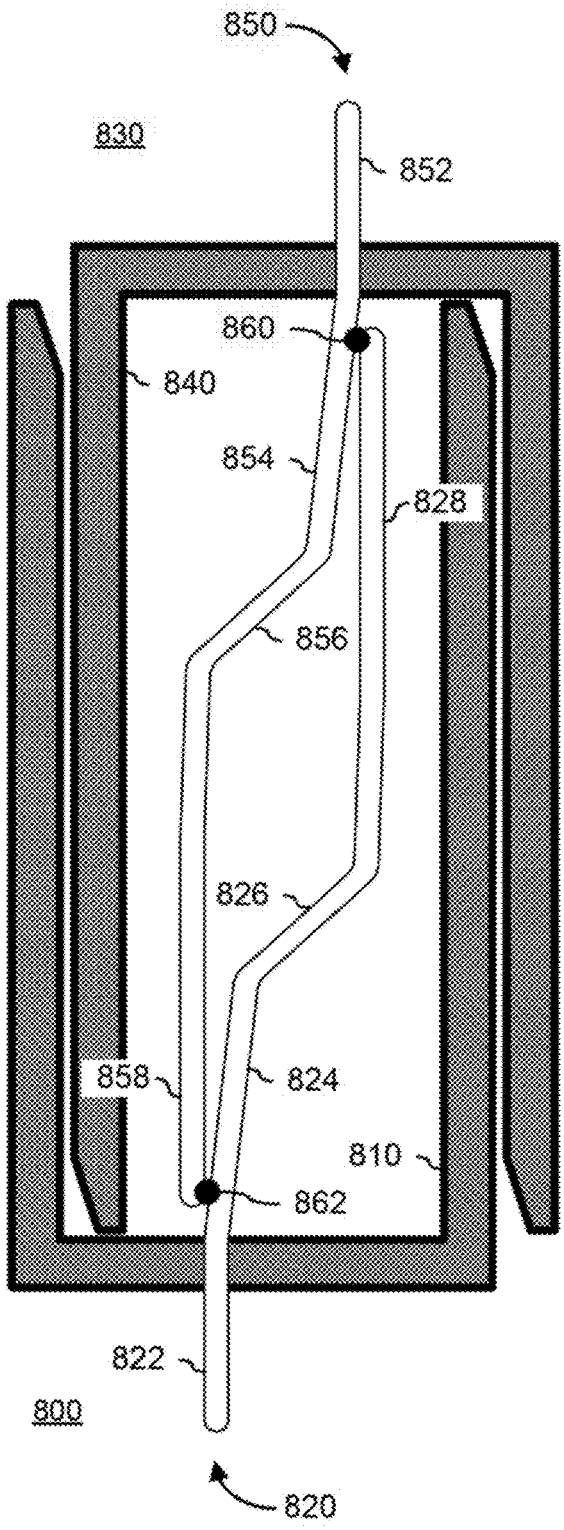
FIG. 8 is a cross-sectional view of a connector element of a connector system according to an embodiment of the present disclosure.

FIG. 8 illustrates a connector system, including connector element 800 and a fully inserted mating connector element 830. Connector element 800 and mating connector element 830 are similar to connector element 200. Connector element 800 includes a connector element housing 810 and a contact 820, and mating connector element 830 includes a connector element housing 840 and a contact 850.

Contact 820 includes a tail region 822 similar to tail region 222, a wipe region 824 similar to wipe region 224, a ramp region 826 similar to ramp region 226, except as described further below, and a contact region 828 similar to contact region 228. Contact 850 includes a tail region 852 similar to tail region 222, a wipe region 854 similar to wipe region 224, a ramp region 856 similar to ramp region 226, except as described further below, and a contact region 858 similar to contact region 228. In this embodiment, the spurious contact described with respect to FIG. 4, above, is avoided because, as mating connector element 830 is inserted in to connector element 800, contact region 828 first comes into physical contact with ramp region 856 and contact region 852 first comes into physical contact with ramp region 826, in such a way that the tips of the contact regions make a point contact with the ramp regions, and little to no tuned stub is created thereby. Further, as mating connector element 830 is inserted farther into connector element 800, the point contact is maintained, until, finally, when the mating connector element is fully inserted into the connector element, contact region 828 makes point contact 860 with wipe region 854, and contact region 858 makes point contact 862 with wipe region 824.

In the embodiment of FIG. 8, the profile of contacts 820 and 850 may advantageously avoid the creation of spurious contact regions that form unwanted tuned stubs at the contact region of the contacts. However, given that contact region 828 first contacts ramp region 856 at a more oblique angle than would be the case where two ramp regions interact with each other, as shown in FIG. 4, and that contact region 858 similarly first contacts ramp region 826 at a more oblique angle, the present embodiment may lead to adverse scoring of the ramp regions, or to bending of one or more of contacts 820 or 850. As such, a choice as to the suitability of the embodiment shown in FIGS. 3-6 versus the embodiment shown in FIG. 8 may rest on various design or material considerations, as needed or desired.

Figure 9:
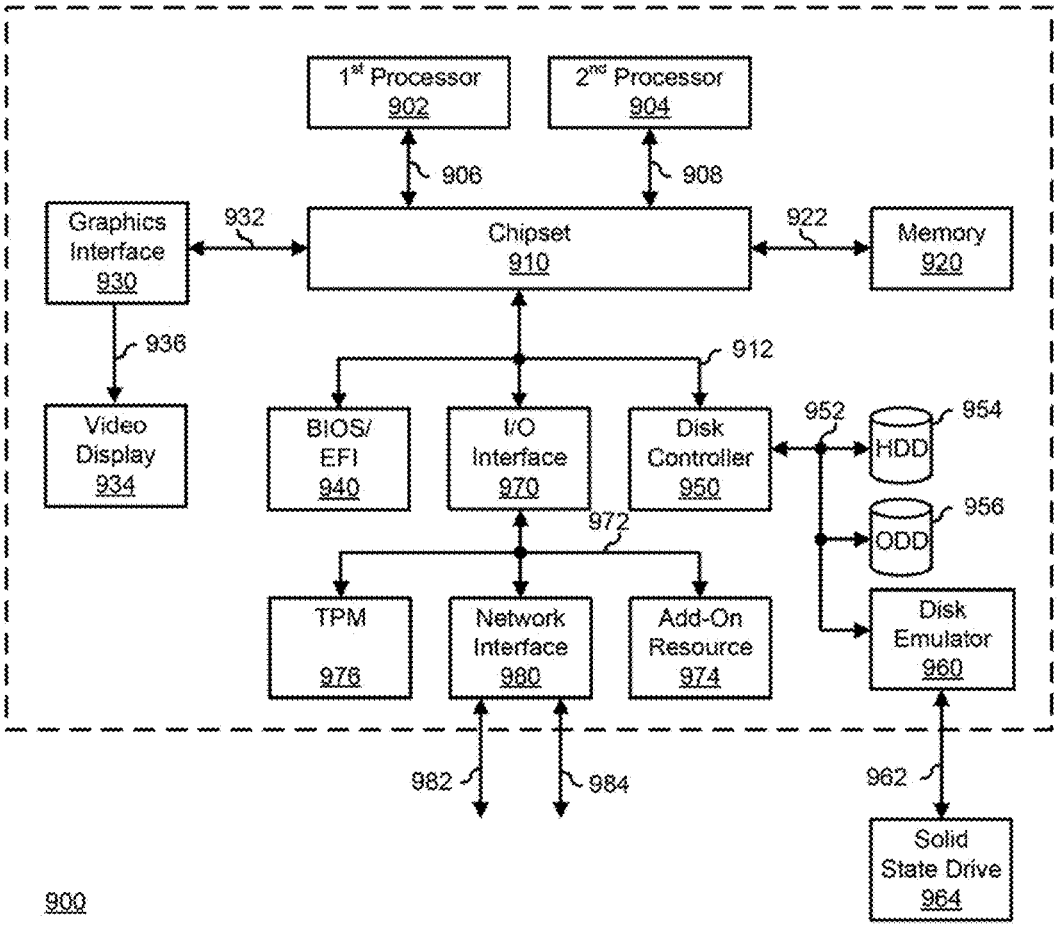
FIG. 9 is a block diagram illustrating a generalized information handling system according to an embodiment of the present disclosure.

FIG. 9 illustrates a generalized embodiment of information handling system 900. For purpose of this disclosure information handling system 900 can include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, information handling system 900 can be a personal computer, a laptop computer, a smart phone, a tablet device or other consumer electronic device, a network server, a network storage device, a switch router or other network communication device, or any other suitable device and may vary in size, shape, performance, functionality, and price. Further, information handling system 900 can include processing resources for executing machine-executable code, such as a central processing unit (CPU), a programmable logic array (PLA), an embedded device such as a System-on-a-Chip (SoC), or other control logic hardware. Information handling system 900 can also include one or more computer-readable medium for storing machine-executable code, such as software or data. Additional components of information handling system 900 can include one or more storage devices that can store machine-executable code, one or more communications ports for communicating with external devices, and various input and output (I/O) devices, such as a keyboard, a mouse, and a video display. Information handling system 900 can also include one or more buses operable to transmit information between the various hardware components. One or more of the components of information handling system 900 can be connected together via a high speed data connector as described above.

Information handling system 900 can include devices or modules that embody one or more of the devices or modules described above, and operates to perform one or more of the methods described above. Information handling system 900 includes a processors 902 and 904, a chipset 910, a memory 920, a graphics interface 930, include a basic input and output system/extensible firmware interface (BIOS/EFI) module 940, a disk controller 950, a disk emulator 960, an input/output (I/O) interface 970, and a network interface 980. Processor 902 is connected to chipset 910 via processor interface 906, and processor 904 is connected to the chipset via processor interface 908. Memory 920 is connected to chipset 910 via a memory bus 922. Graphics interface 930 is connected to chipset 910 via a graphics interface 932, and provides a video display output 936 to a video display 934. In a particular embodiment, information handling system 900 includes separate memories that are dedicated to each of processors 902 and 904 via separate memory interfaces. An example of memory 920 includes random access memory (RAM) such as static RAM (SRAM), dynamic RAM (DRAM), non-volatile RAM (NV-RAM), or the like, read only memory (ROM), another type of memory, or a combination thereof.

BIOS/EFI module 940, disk controller 950, and I/O interface 970 are connected to chipset 910 via an I/O channel 912. An example of I/O channel 912 includes a Peripheral Component Interconnect (PCI) interface, a PCI-Extended (PCI-X) interface, a high-speed PCI-Express (PCIe) interface, another industry standard or proprietary communication interface, or a combination thereof. Chipset 910 can also include one or more other I/O interfaces, including an Industry Standard Architecture (ISA) interface, a Small Computer Serial Interface (SCSI) interface, an Inter-Integrated Circuit ($I^2C$) interface, a System Packet Interface (SPI), a Universal Serial Bus (USB), another interface, or a combination thereof. BIOS/EFI module 940 includes BIOS/EFI code operable to detect resources within information handling system 900, to provide drivers for the resources, initialize the resources, and access the resources. BIOS/EFI module 940 includes code that operates to detect resources within information handling system 900, to provide drivers for the resources, to initialize the resources, and to access the resources.

Disk controller 950 includes a disk interface 952 that connects the disc controller to a hard disk drive (HDD) 954, to an optical disk drive (ODD) 956, and to disk emulator 960. An example of disk interface 952 includes an Integrated Drive Electronics (IDE) interface, an Advanced Technology Attachment (ATA) such as a parallel ATA (PATA) interface or a serial ATA (SATA) interface, a SCSI interface, a USB interface, a proprietary interface, or a combination thereof. Disk emulator 960 permits a solid-state drive 964 to be connected to information handling system 900 via an external interface 962. An example of external interface 962 includes a USB interface, an IEEE 1394 (Firewire) interface, a proprietary interface, or a combination thereof. Alternatively, solid-state drive 964 can be disposed within information handling system 900.

I/O interface 970 includes a peripheral interface 972 that connects the I/O interface to an add-on resource 974, to a TPM 976, and to network interface 980. Peripheral interface 972 can be the same type of interface as I/O channel 912, or can be a different type of interface. As such, I/O interface 970 extends the capacity of I/O channel 912 when peripheral interface 972 and the I/O channel are of the same type, and the I/O interface translates information from a format suitable to the I/O channel to a format suitable to the peripheral channel 972 when they are of a different type. Add-on resource 974 can include a data storage system, an additional graphics interface, a network interface card (NIC), a sound/video processing card, another add-on resource, or a combination thereof. Add-on resource 974 can be on a main circuit board, on separate circuit board or add-in card disposed within information handling system 900, a device that is external to the information handling system, or a combination thereof.

Network interface 980 represents a NIC disposed within information handling system 900, on a main circuit board of the information handling system, integrated onto another component such as chipset 910, in another suitable location, or a combination thereof. Network interface device 980 includes network channels 982 and 984 that provide interfaces to devices that are external to information handling system 900. In a particular embodiment, network channels 982 and 984 are of a different type than peripheral channel 972 and network interface 980 translates information from a format suitable to the peripheral channel to a format suitable to external devices. An example of network channels 982 and 984 includes InfiniBand channels, Fibre Channel channels, Gigabit Ethernet channels, proprietary channel architectures, or a combination thereof. Network channels 982 and 984 can be connected to external network resources (not illustrated). The network resource can include another information handling system, a data storage system, another network, a grid management system, another suitable resource, or a combination thereof.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

The above-disclosed subject matter is to be considered illustrative, and not restrictive, and the appended claims are intended to cover any and all such modifications, enhancements, and other embodiments that fall within the scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A connector system comprising:

a first connector element including a first contact that has a first contact region, a first wipe region, and a first ramp region positioned between the first contact region and the first wipe region, the first ramp region including a first non-conductive layer; and a second connector element including a second contact that has a second contact region, a second wipe region, and a second ramp region positioned between the second contact region and the second wipe region, the second ramp region including a second non-conductive layer, wherein:

when the first connector element is partially mated with the second connector element, no electrical point contact between the first contact and the second contact is made;

when the first connector element is mated with the second connector element, the first contact region makes a first point electrical contact with the second wipe region such that the first contact does not form a first tuned stub; and when the first ramp region and the second ramp region engage, no electrical point contact between the first contact and the second contact is made.

2. The connector system of claim 1 wherein further, when the first connector element is mated with the second connector element, the second contact region makes a second point electrical contact with the first wipe region such that the second contact does not form a second tuned stub.

3. The connector system of claim 1:

the first connector element further including a first connector housing configured to secure the first contact; and the second connector element further including a second connector housing configured to secure the second contact.

4. The connector system of claim 1 wherein, when the first connector element is mated with the second connector element, the first connector housing and the second connector housing form a male-female pair.

5. The connector system of claim 1 wherein, when the first connector element is mated with the second connector element, the first connector housing and the second connector housing form a hermaphroditic pair.

6. The connector system of claim 1 wherein, when the first connector element is being mated with the second connector element, but prior to when the first connector element is mated with the second connector element, the first ramp region and the second ramp region engage to lift the first contact region over the second wipe region and to lift the second contact region over the first wipe region.

7. A connector comprising:

a contact that includes a contact region, a wipe region, and a ramp region positioned between the contact region and the wipe region; and a housing configured to secure the contact, wherein:

when the connector is partially mated with another connector, no electrical point contact between the contact and the other connector is made;

when the connector is mated with another connector, the contact region makes a point electrical contact with a wipe region of the other connector such that the contact does not form a tuned stub;

when the connector is being mated with the other connector, but prior to when the connector is mated with the other connector, the ramp region and another ramp region of the other contact engage to lift the contact region over another wipe region of the other contact; and the ramp region includes a non-conductive layer such that when the ramp region and the other ramp region engage, no electrical point contact between the contact and the other contact is made.

8. The connector of claim 7 wherein, when the connector is mated with the other connector element, the housing and a housing of the second connector form a male-female pair.

9. The connector of claim 7 wherein, when the connector is mated with the other connector element, the housing and a housing of the second connector form a hermaphroditic pair.

10. A method comprising:

providing, on a first contact of a first connector element, a first contact region, a first wipe region, and a first ramp region positioned between the first contact region and the first wipe region, the first ramp region including a first non-conductive layer;

providing, on a second contact of a second connector element, a second contact region, a second wipe region, and a second ramp region positioned between the second contact region and the second wipe region, the second ramp region including a second non-conductive layer; and mating the first connector element with the second connector element, wherein:

when partially mated, no electrical point contact between the first connector element and the second connector element is made;

when mated, the first contact region makes a first point electrical contact with the second wipe region such that the first contact does not form a first tuned stub;

when the first ramp region and the second ramp region en age, no electrical point contact between the first contact and the second contact is made.

11. The method of claim 10, wherein further, when mated, the second contact region makes a second point electrical contact with the first wipe region such that the second contact does not form a second tuned stub.

12. The method of claim 10:

providing, on the first connector element, a first connector housing configured to secure the first contact; and providing, on the second connector element, a second connector housing configured to secure the second contact.

13. The method of claim 10, wherein, when the first connector element is mated with the second connector element, the first connector housing and the second connector housing form a male-female pair.

14. The method of claim 10, wherein, when the first connector element is mated with the second connector element, the first connector housing and the second connector housing form a hermaphroditic pair.

15. The method of claim 10, further comprising:

engaging the first ramp region with the second ramp region to lift the first contact region over the second wipe region and to lift the second contact region over the first wipe region, prior to when the first connector element is mated with the second connector element.

* * * * *